US008464373B2

(12) United States Patent
Wranne

(10) Patent No.: US 8,464,373 B2
(45) Date of Patent: Jun. 18, 2013

(54) BED WITH SLATS

(76) Inventor: Olof Wranne, Göteborg (SE)

( * ) Notice: Subject to any disclaimer, the term of this patent is extended or adjusted under 35 U.S.C. 154(b) by 267 days.

(21) Appl. No.: 12/090,860

(22) PCT Filed: Oct. 26, 2006

(86) PCT No.: PCT/IB2006/003010
§ 371 (c)(1),
(2), (4) Date: Aug. 14, 2008

(87) PCT Pub. No.: WO2007/049135
PCT Pub. Date: May 3, 2007

(65) Prior Publication Data

US 2009/0217454 A1 Sep. 3, 2009

(30) Foreign Application Priority Data

Oct. 27, 2005 (SE) ..... 0502382

(51) Int. Cl.
*A47C 23/00* (2006.01)

(52) U.S. Cl.
USPC ..... 5/236.1; 5/191

(58) Field of Classification Search
USPC ..... 5/236.1, 237, 239, 191; 297/452.63; 267/102, 158, 160, 164–165
See application file for complete search history.

(56) References Cited

U.S. PATENT DOCUMENTS

| | | | | |
|---|---|---|---|---|
| 1,893,098 | A | 1/1933 | Murray, Sr. et al. | |
| 2,127,558 | A | 8/1938 | Freund | |
| 4,158,899 | A | 6/1979 | Budimirov | |
| 5,280,658 | A * | 1/1994 | Sigl | 5/236.1 |
| 6,868,565 | B2 * | 3/2005 | Frey | 5/190 |

FOREIGN PATENT DOCUMENTS

| | | | |
|---|---|---|---|
| CH | 602057 | A5 | 7/1978 |
| DE | 3511476 | A1 | 10/1985 |
| DE | 29613294 | U1 | 9/1996 |
| DE | 19632960 | A1 | 2/1998 |
| DE | 19900270 | A1 | 7/2000 |
| FR | 1569242 | A | 5/1969 |
| SE | 356891 | B | 6/1973 |

OTHER PUBLICATIONS

EPO, Intl Search Report in PCT/IB2006/003010, Aug. 8, 2007.

* cited by examiner

*Primary Examiner* — Fredrick Conley
(74) *Attorney, Agent, or Firm* — Potomac Patent Group PLLC

(57) ABSTRACT

A bed has a number of parallel slats arranged at a distance from each other. The slats form a substantially horizontal plane, and in areas near the ends of the slats, the slats are fixed to a frame, with the central portion of the slats forming the lying surface of the bed. The slats, in areas between the central portion and the ends, are bent at least two times in each of the areas, and the stiffness of the slats is higher within an area about the middle of the central portion than at the ends of the central portion.

11 Claims, 5 Drawing Sheets

BED WITH SLATS

TECHNICAL FIELD

The present invention relates to a bed primarily consisting of a number of parallel slats arranged at a distance from each other, forming a substantially horizontal plane, said slats, in an area near the ends of the slat, being fixed to a frame and the central portion of the slats forming the lying surface of the bed.

PRIOR ART

The traditional design of a bed is to use a mattress including interior springs or a hard bottom together with an elastic mattress. The disadvantages of traditional beds are, among other things, the assembly problems, the weight and the low cost-effectiveness as well as the mattress after a time being marred by certain hygienic shortcomings.

There are a number of pieces of furniture having alternative solutions. U.S. Pat. No. 4,158,899 shows, among other things, a piece of seating furniture having a seat that consists of an integral unit of deflected slats with slits between the slats. The object of the design of the seat is to afford a user good comfort irrespective of where on the seat the user is located. The construction is only suitable for smaller pieces of furniture and would, because of the design thereof, not possess the same comfort if it were manufactured in greater dimensions and would also become unwieldy.

FR-A-325,351 shows a bed the resilient surface of which consists of elastic metal strips, which are double bent in the end portions thereof and are horizontally attached to a bed frame surrounding the metal strips. The distance between the attachment points is generally equally great as the width of the resilient surface, which considerably impairs the resilient properties of the metal strips. This, in combination with the design of the metal strips, makes that the bed probably becomes fairly uncomfortable since the metal strips will sag considerably more in the middle of the width of the bed than at the edges thereof.

U.S. Pat. No. 100,116 shows a car seat consisting of a number of parallel slats arranged at a distance from each other with the purpose of letting through dust between the slats. The slats are bent once and having a distance between the attachment points of the slats in the frame that is smaller than the length of the central portion of the slats. The design of the car seat provides a seat that possibly is nice to a user sitting still with the centre of gravity relatively centred on the middle of the slats, but as fast as the location of the centre of gravity is moved, the seat becomes considerably harder and consequently not equally comfortable.

Accordingly, there is a need for a bed formed in such a way that it is easy to manufacture and assemble, that has a low weight and that is hygienic at the same time as it is comfortable irrespective of where on the bed you are.

SUMMARY OF THE INVENTION

Thus, the object of the present invention is to provide a bed having a design that solves the above-mentioned problems. Said object is attained by means of a bed that is characterized in that the slats in the areas between the central portion of the slats and the ends of the slats are bent more than two times in said areas, that the distance between the attachment points of the slats in the frame are shorter than the central portion of the slats, that at least some of the slats have a varying stiffness, the stiffness of the slats being higher within an area about the middle of the respective central portion thereof than at the ends of the respective central portion and varying in such a way that the slats are subjected to a substantially equally great vertical deflection irrespective of where on the lying surface that a force is applied, the increased stiffness of the slats being provided by the fact that the thickness of the slats and/or the width of the slats and/or the modulus of elasticity of the slats are/is greater within an area about the middle of the respective central portion thereof than at the ends of the respective central portion. Advantageous embodiments are defined in the appurtenant dependent claims.

BRIEF DESCRIPTION OF THE DRAWINGS

In the following, the invention will be described in a non-limiting way and for illustrative purposes, reference being made to accompanying figures wherein.

DETAILED DESCRIPTION OF THE INVENTION

Figure 1:
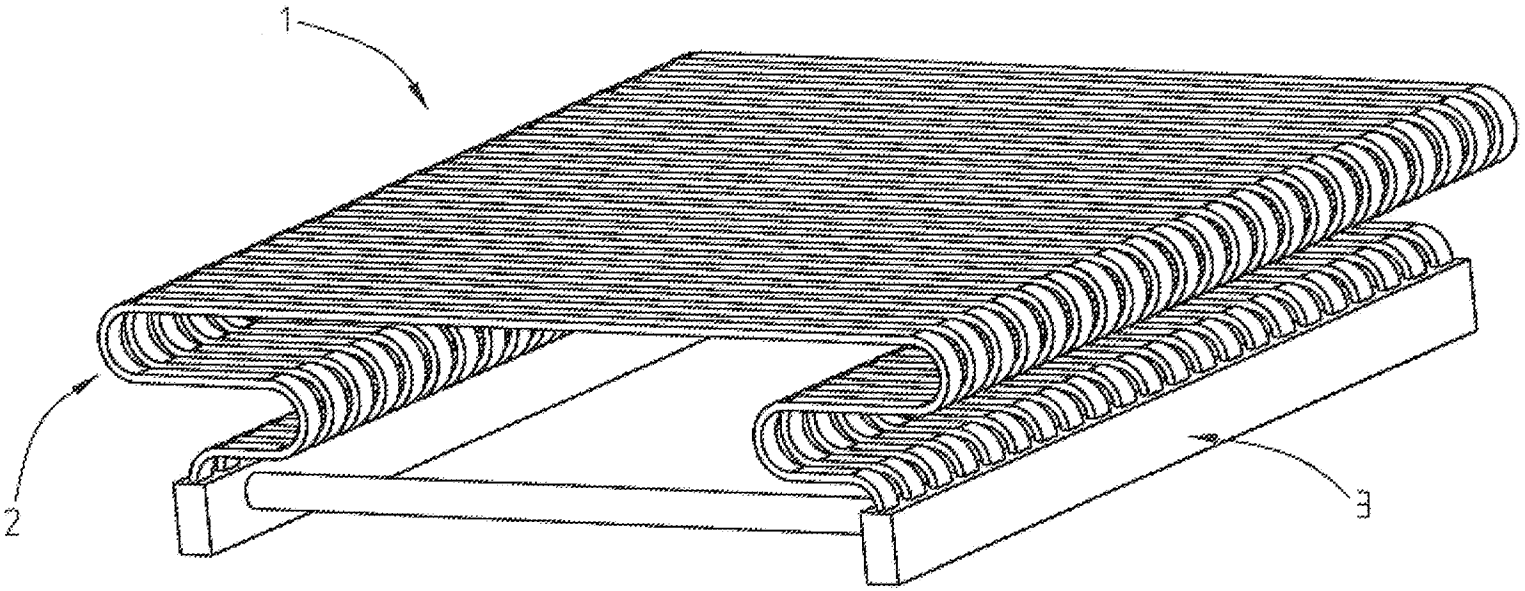
FIG. 1 shows a perspective view of a bed according to the invention.

FIG. 1 shows a perspective view of a bed 1 according to the invention. The bed is constructed from a plurality of slats 2 arranged in or adjacent to a frame 3. The slats are arranged at a certain distance from each other and perpendicularly in relation to the longitudinal direction of the bed. The middle portion of the slats forms a substantially horizontal plane, which is the lying surface of the bed. In the ends thereof, which should be interpreted as an area adjacent to the ends, the slats are vertically fixed to the frame 3. Each slat 2 is, in an area between the middle portion of the slats and the ends of the slats, bent two and a half times in each of said areas. By the slats being bent should be meant that the direction of the extension of the slats has been changed by approximately 180°, irrespective of this change of direction taking place continuously or in the form of a plurality of smaller or greater steps. Thus, a half bend is approximately 90°. Hence, the slats according to the example are bent more than two times. If the slat, in addition to the two upper bends, has a small angular change in the ends thereof, i.e., that the end is not horizontal but is fixed to the frame at an angle of, e.g., 45°, the slat is bent 2.25 times in each end area and is thus bent more than 2 times.

The slats do not have to be bent 2.5 times, even if it apparently provides advantageous stability of the slats, but they may be bent both more and fewer times. However, in order to have a both vertical and horizontal stability, neither should they be bent too many nor too few times. The number of bends on each side of a slat should be between two and five, and preferably between two and three. The fact that each slat is bent more than two times entails that the bed is given an increased resilience in comparison with beds and furniture where the number of bends is two or fewer. This is desirable when the distance between the attachment points 2*a*, 2*g* of the slats in the frame 3 is shorter than the central portion 2*d* of the slats, such as is shown in FIG. 2, since this entails a generally increased stiffness to the lying surface.

In the example, the attachment of the slats 2 in the frame 3 is vertical. The ends of the slats are vertically arranged in slots or openings in the frame. However, the slats may also be attached on the outside or on the inside of the frame instead of in slots or openings in the frame. It neither needs to be the ends that are fixed in or to the frame, but it may be an area positioned a bit away from the end portion. A vertical attachment gives a good stability, but the slats may also be fixed in openings or slots in the frame 3, alternatively at the frame, at a certain inclination without the stability being impaired drastically. According to a preferred embodiment of the present invention, the attachment angle θ between a slat 2 and the vertical axis of the frame 3 is arranged to vary in order to change the tension in the slat in such a way. The angle θ is preferably changed by the fact that the slots in the frame 3 that the slats 2 are attached in may be angularly positioned by means of devices in or at the frame, or alternatively bolts may press on the slats adjacent to the attachment and thereby angularly position the slats. Either all slats or certain groups of slats may be angularly positioned simultaneously, e.g., by a common rotatable bar, or each slat may be angularly positioned individually. By angularly positioning individual slats or groups of slats, the stiffness of the slats and thereby the hardness of the bed can be adjusted in appropriately selected parts of the bed. This entails that a user can adapt the bed according to his/her own needs. Since the stiffness of each slat can be adjusted in this way, a user who requires a bed that is harder in certain parts, e.g., in the form of additional support to the back, may adjust the slats in question by varying the attachment angle and thus increase the stiffness of the slat in, among other portions, the central portion thereof. If the stiffness of a slat for different reasons has decreased after the bed has been in use for a time, it is possible to increase the stiffness by changing the attachment angle θ so that the stiffness is equally great as it was upon the purchase of the same. It is also possible to decrease the stiffness of a slat correspondingly. Thus, the attachment angle may be adjusted and adapted according to future stress already in the manufacture of the bed and/or be fine-adjusted during the entire lifetime of the bed.

The attachment is preferably in the form of openings or slots in the frame 3, into which the slats are fitted and then fixed by means of bolts or the like, which press the slats in place in the frame. Additional bolts or other adjustment devices may be used in order to vary the attachment angle θ. The attachment angle may be arranged to vary continuously or in fixed steps. How much the attachment angle has to vary in order to give the desired effect depends on the stiffness of the slat.

Figure 2:
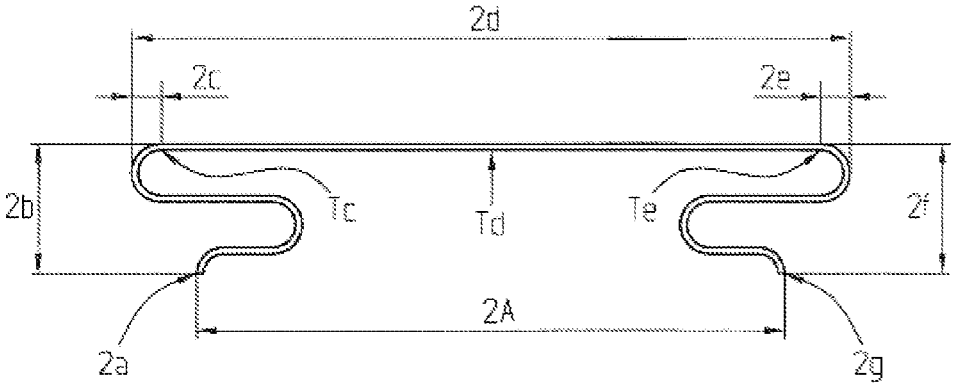
FIG. 2 shows a front view of a bed according to the invention.

FIG. 2 shows a front view of a bed 1 without frame 3 according to the invention. The slats 2 are preferably composed of a single integral piece of material, even if a plurality of joined material pieces may form a slat. In the ends 2*a*, 2*g* thereof, the slats 2 are fixed to a frame 3 (not shown in this figure). The central portion 2*d* of the slats forms the lying surface of the bed and is substantially horizontal. In areas 2*b*, 2*f* between the central portion 2*d* of the slats and the ends 2*a*, 2*g* of the slats, the slats are bent two and a half times in each of said areas. The thickness $T_d$ of the slats within an area about the middle of the central portion 2*d* thereof is greater than the thickness $T_{c,e}$ at the ends 2*c*, 2*e* of the central portion. The variation in thickness may be linear, with a maximum at the middle and a minimum at the ends, but may also be quadratic or vary in any other suitable way. Preferably, the percentage difference of the thickness δ, between the thickness $T_d$ of the middle of the central portion 2*d* and the thickness $T_{c,e}$ of the ends 2*c*, 2*e* of the central portion, i.e., $\delta=100*(T_d-T_{c,e})/T_d$, is in the interval of 15±10 and preferably in the interval of 15±5. In a similar way, also the width of the slats may vary within the same area, even if the width has to vary to a greater extent in order to provide the same effect. In the example, the thickness of the slats is 0.5 cm in the middle of the central portion 2*d* and is approximately 0.42 cm at the ends 2*c*, 2*e* of the central portion 2*d*, and then continuously decrease to 0.3 cm at the ends 2*a*, 2*g* of the slats.

The distance A between the attachment points 2*a*, 2*g* of the slats in the frame (not shown in FIG. 2) is shorter than the central portion 2*d* of the slats that forms the lying surface of the bed. This entails a substantially increased stability compared to if the distance would be greater or the same. In the example, the attachment points are positioned 10 cm from the outer ends of the lying surface and accordingly at a distance A=70 cm, since the width of the bed is 90 cm. This position may naturally be modified, but too great a change of the position would presumably result in inferior stability properties.

Figure 3:
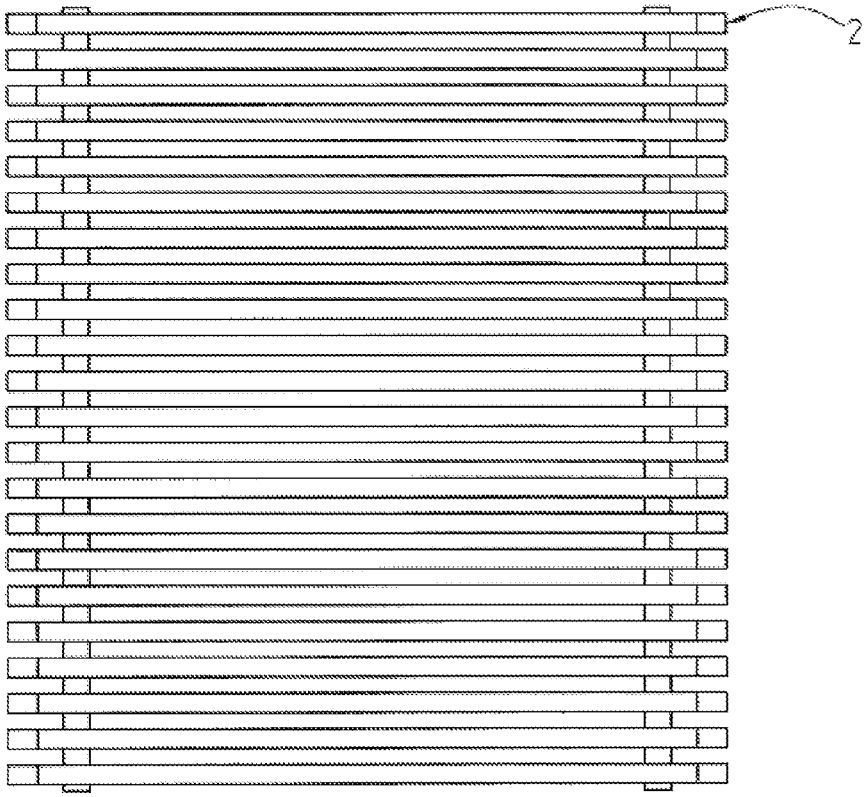
FIG. 3 shows a bed according to the invention as seen from above.

FIG. 3 shows a bed according to FIGS. 1 and 2 as seen from above.

Figure 4:
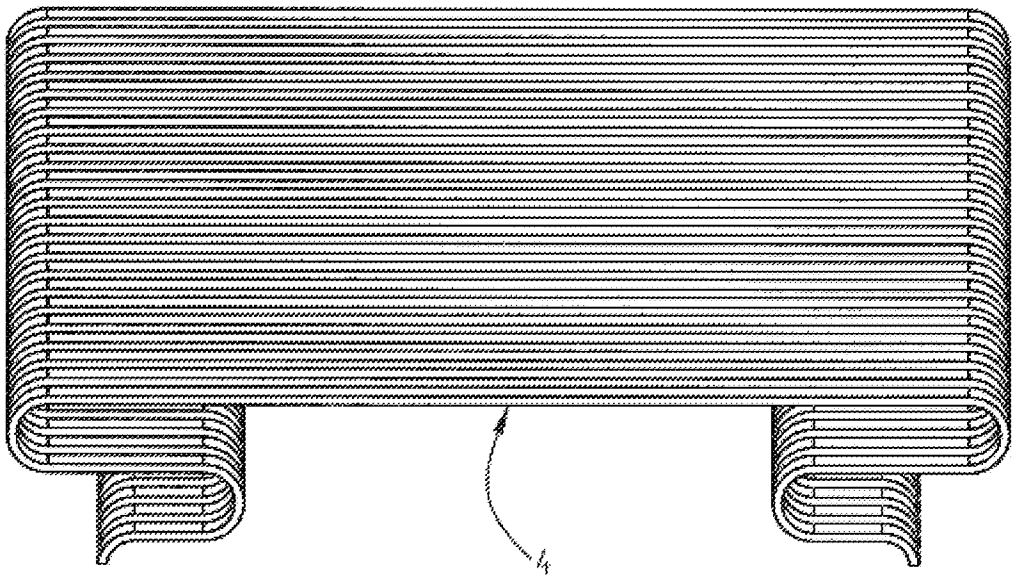
FIG. 4 shows a perspective view of a bed according to a preferred embodiment of the invention.

FIG. 4 shows a perspective view of a bed 1 according to a preferred embodiment of the invention. In this embodiment, a central beam 4 is arranged perpendicularly in relation to the slats 2 in the centre of the central portion 2*d*. Calculations show that by placing a beam 4 having a height of 0.1 cm and a width of 1 cm in the centre of the central portion 2*d*, an increased stiffness of the bed 1 is achieved. At a load of 7 kN, the slats are displaced less than 5 cm in the vertical direction in comparison with a displacement of slightly more than 7 cm at the same load without the beam 4. In particular, the displacement is decreased in the immediate surroundings of the beam. In order to provide still more stiffness, a plurality of beams may be placed at selected positions, thereby keeping together the slats further. The beams do not have to extend along the length of the entire bed, and the positions thereof may be selected as desired. Comparisons with tests made on traditional beds show that the vertical displacement of the slat bed without the central beam 4 is approximately the same as the displacement of said traditional beds. When adding a central beam as above, the vertical displacements of the slat bed 1 becomes a shade smaller than of said traditional beds. The addition of one or more beams is also a way to make the bed stiffer at certain selected locations.

In this example, the slats have a width of approximately 3 cm with a distance between the slats of approximately 5 cm, which means that 26 slats are required for a bed having a length of 2 m. In the example, the width of the bed is 90 cm and the height above the frame is about 20 cm. Each bend has a radius of 4 cm and the straight areas between the radii are 15 and 5 cm, respectively. Taken together, this means, in this example, that each slat has a length of about 190 cm. The size of the slats may naturally be varied according to the size of the bed and also according to the stresses that the bed will be subjected to, but the width of the slats is preferably in the interval of 5±3 cm. If the width decreases, the thickness of the slats should be increased correspondingly to retain the stiffness of the slats, provided that slats having a greater resilience are not desired. The distance between the slats may also alter correspondingly. The bends of the slats may also be of different sizes, i.e., the bend closer to the lying surface may be either greater, the same, or smaller than a bend situated closer to the frame. The bends of the slats do not have to be strictly semicircular, but the bends may also consist of a number of steps and thereby correspond to a half polygon or have a geometry such as in FIG. 1.

If it is desired to obtain a bed having different resilience in different areas of the bed, this can be attained in a variety of ways. If, e.g., a part of the bed should be hard, the thickness and/or the width of the slats may be increased in said part. Alternatively or in combination with this, the distance between the slats may be decreased. Another possibility is to change the attachment angle θ as above. A further possibility is to attach one or more laths or beams 4 to the slats approximately in the longitudinal direction of the bed and in such a way join the slats. Said laths or beams are preferably, but not necessarily, perpendicular in relation to the slats. A number of the slats may also be manufactured from a material having a modulus of elasticity that differs from the one of other slats in order to provide a varying stiffness between the slats in such a way. The choice of material may also vary within the same slat, i.e., parts of the slat may be manufactured from a stiffer material, e.g., that the slats within an area about the middle of the central portion 2*d* thereof are manufactured from a material having a higher modulus of elasticity than the material in the area at the ends 2*c*, 2*e* of the central portion 2*d*. This causes the stiffness of the slat to vary along the longitudinal direction thereof without any, or at all events any greater, variations of the dimension of the slat needing to be made. An advantage of this embodiment is that even if the different slats of the bed are going to possess different stiffness, a similar shape may be used in the manufacture of the different slats. The only thing that needs to vary is the amount of the different materials included in the slat. If a high stiffness is desired, selection is made of a material having a high E-modulus in the middle of the central portion and one or more materials having a somewhat smaller E-modulus toward the edges. If a somewhat smaller stiffness is desired, a smaller quantity of the above-mentioned material having a high E-modulus is used or a material having a lower E-modulus is selected.

Figure 5:
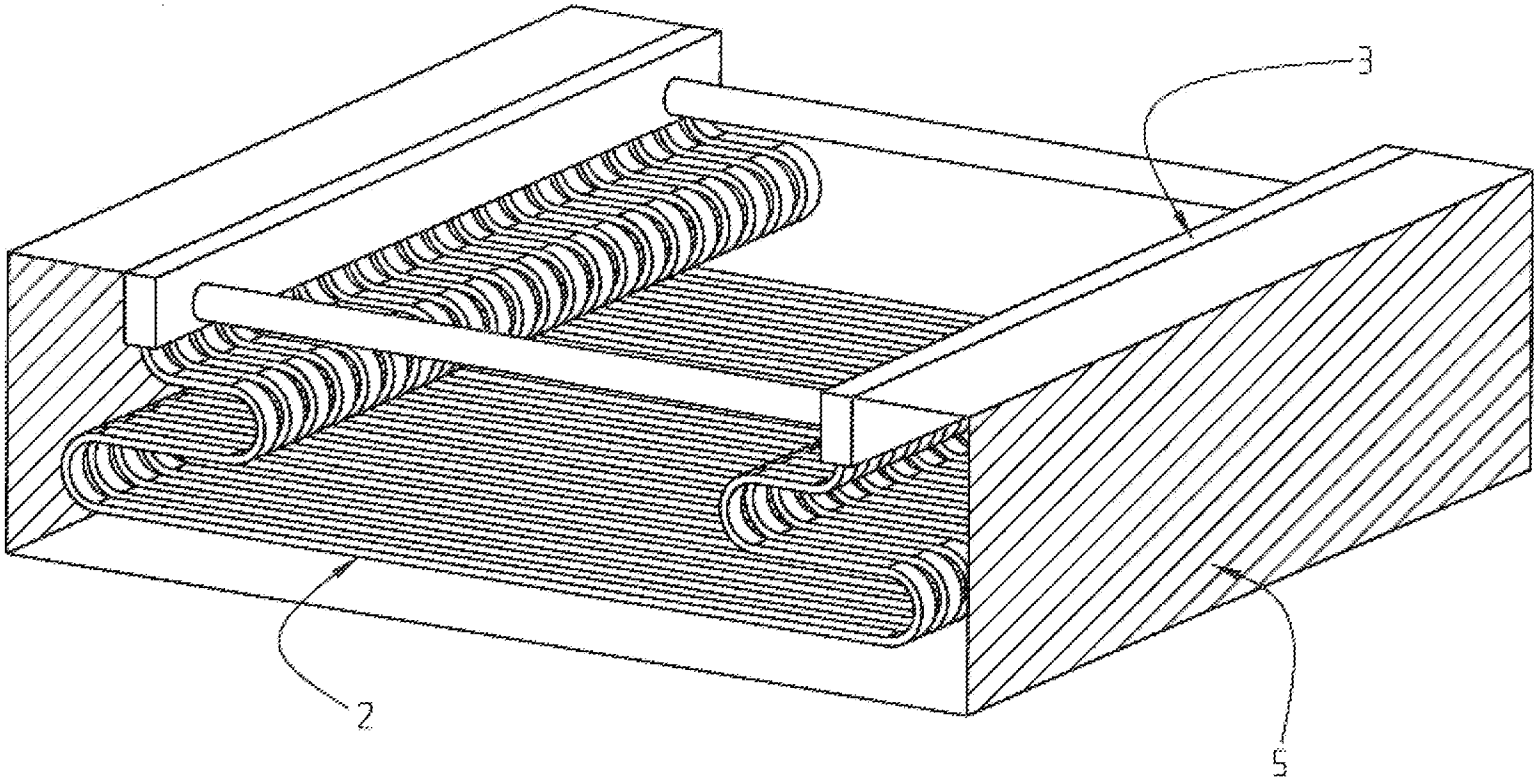
FIG. 5 shows a perspective view of a bed according to an alternative embodiment of the invention.

FIG. 5 shows a perspective view of a bed 1 according to an alternative embodiment of the invention. In this design, the frame 3 is positioned above the central portion 2*d* of the slats, i.e., the entire bed according to the previous embodiments is turned upside and down. In this embodiment, the frame 3 has to be attached to a surrounding stand 5 and the entire central portion 2*d* will not be usable as a lying surface. However, in other respects, the bed will be subjected to generally the same load as in the previous examples and the displacement of the slats will be approximately the same as in the previous examples. A bed according to this embodiment is not given the same aesthetic design as previously mentioned examples, but it gets a frame that in a natural way entirely surrounds the bed and provides it with edges, which may be desirable in some cases.

Figure 6:
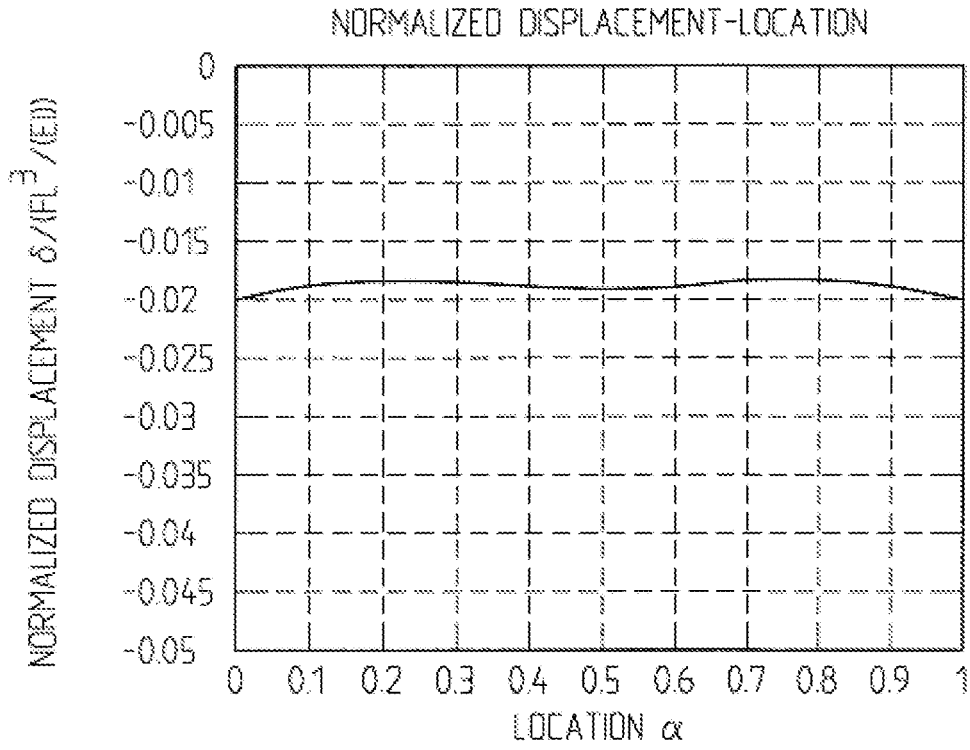
FIG. 6 shows a diagram of the vertical displacement at different positions along the lying surface of a bed according to the invention.

FIG. 6 shows a diagram of calculations of the vertical displacement at different positions along the lying surface of a bed 1 according to the invention. The deviation given on the y-axis is a normalized deviation, which thereby is dimensionless. As is seen, the vertical deviation becomes generally constant along the width of the entire bed. The greatest difference in the deviation is 0.0014, which means an actual difference in the deviation of approximately 0.5 cm if an applied force of approx. 90 N has been put on an area of $0.16^2$ $m^2$.

The slats are preferably manufactured from aluminum or any other metal possessing a low weight and being easy to form, but other suitable materials may, e.g., be a composite material, a polymer, wood, a metal or a mixture thereof.

To sum up, a bed according to the present invention gets a number of unique properties in relation to prior art. It is inexpensive to manufacture since it only consists of a frame and a number of slats together with an appurtenant overlay mattress. It is easy to assemble and transport—all the parts may be shipped individually and the bed may be assembled at the desired location in the bedroom, which means that heavy lifts of the bed are minimized. It is hygienic since the amount of fabric and padding is minimized, and it does not collect dust or mites. All parts are recyclable—everything can be sorted into elementary environmental-friendly fractions. The bed has a high design value, and the bed may, above all, be adjusted and varied for different load cases and thereby be adjusted individually according to the weight and shape of the user. In its simple design, the bed is also relatively inexpensive to manufacture.

The nature and the function of the invention should have been clear from what has been mentioned above and shown in the drawings, and the invention is naturally not limited to the embodiments described above and shown in the accompanying drawings. Modifications are feasible, particularly as for the nature of the different parts, or by using an equivalent technique, without departing from the protection area of the invention, such as it is defined in the claims.

The invention claimed is:

1. A bed, comprising:

a number of parallel slats arranged at a distance from each other and forming a substantially horizontal plane, and a frame, wherein the slats, in areas near ends of the slats, are attached to the frame;

central portions of the slats form a lying surface of the bed;

the slats, in areas between the central portions and the ends, are bent more than two times in the areas, the slats changing direction at each bend by approximately 180 degrees;

distances (A) between attachment points of the slats in the frame are shorter than the central portions;

at least some of the slats have stiffnesses that individually vary along lengths of the slats, whereby the bed can be made stiffer at selected locations, the stiffness of each of a plurality of the at least some of the slats being higher within an area about a middle of the central portion of the respective slat than at outer ends of the central portion close to the areas where the slats are bent and varying such that the respective slat is subject to a substantially equally great vertical deflection irrespective of where on the lying surface a force is applied;

the vertical deflection being substantially constant along substantially the entire width of the bed;

the higher stiffness of a slat of the plurality of at least some of the slats being provided by at least one of a greater thickness of the slat, a greater width of the slat, and a greater modulus of elasticity of the slat within an area about the middle of the slat's respective central portion than at the ends of the central portion and any selected location; and different slats of the at least some of the slats having stiffnesses that vary have different stiffnesses according to at least one of different dimensions and different material compositions of the slats, and are bent more than two times in the respective areas between the central portions and the ends of the slats.

2. The bed of claim 1, wherein the number of parallel slats are substantially vertically attached in corresponding apertures in the frame.

3. The bed of claim 2, wherein the number of parallel slats are attached at a certain angle of inclination (θ) in the corresponding apertures in the frame.

4. The bed of claim 1, wherein at least some of the attachment points are adjustable at different attachment angles (θ) in relation to a vertical axis of the frame, thereby varying the stiffness of the slats.

5. The bed of claim 1, wherein a slat of the number of parallel slats, in the area between the central portion and the ends of the slat, is bent more than two times but fewer than five times.

6. The bed of claim 1, wherein the frame is situated above the central portions of the slats.

7. The bed of claim 1, wherein the number of parallel slats are manufactured from aluminum or another light-weight metal.

8. The bed of claim 1, wherein the number of parallel slats are manufactured from a composite material, a polymer, wood, a metal, or a combination thereof.

9. The bed of claim 1, further comprising at least one central beam arranged substantially perpendicularly in relation to the number of parallel slats in the central portions.

10. The bed of claim 1, wherein a percentage thickness difference δ between a thickness Td of a middle of a central portion and a thickness Tc,e of the ends of the central portion is given by:

$$\delta=100*(Td-Tc,e)/Td$$

and is in an interval of 15±10.

11. The bed of claim 10, wherein the percentage thickness difference is in an interval of 15±5.

* * * * *